US008869905B2

(12) United States Patent
Thomas, III et al.

(10) Patent No.: US 8,869,905 B2
(45) Date of Patent: Oct. 28, 2014

(54) ACTUATION MECHANISM FOR A FIRE EXTINGUISHER

(75) Inventors: Robert S. Thomas, III, Baltimore, MD (US); Edward C. Waters, III, New Windsor, MD (US)

(73) Assignee: Universal Delivery Devices, Inc., Baltimore, MD (US)

( * ) Notice: Subject to any disclaimer, the term of this patent is extended or adjusted under 35 U.S.C. 154(b) by 530 days.

(21) Appl. No.: 13/246,106

(22) Filed: Sep. 27, 2011

(65) Prior Publication Data

US 2012/0073839 A1 Mar. 29, 2012

Related U.S. Application Data

(60) Provisional application No. 61/386,829, filed on Sep. 27, 2010.

(51) Int. Cl.
*A62C 11/00* (2006.01)
*A62C 13/76* (2006.01)

(52) U.S. Cl.
CPC ..... *A62C 13/76* (2013.01)
USPC ..... 169/30; 169/33

(58) Field of Classification Search
CPC .... A62C 13/00; A62C 13/003; A62C 13/006; A62C 13/64
USPC ..... 169/30, 71, 77, 85, 88, 19, 20, 33
See application file for complete search history.

(56) References Cited

U.S. PATENT DOCUMENTS

| | | | | |
|---|---|---|---|---|
| 1,326,927 | A * | 1/1920 | Hall | 222/402 |
| 3,228,474 | A * | 1/1966 | Huthsing, Jr. | 169/85 |
| 6,702,033 | B1 * | 3/2004 | Mitchell et al. | 169/85 |
| 8,024,849 | B2 * | 9/2011 | Geyer | 29/505 |
| 8,083,003 | B2 * | 12/2011 | Felten et al. | 169/73 |

* cited by examiner

*Primary Examiner* — Davis Hwu
(74) *Attorney, Agent, or Firm* — Welsh Flaxman & Gitler LLC

(57) ABSTRACT

A fire extinguisher with an actuation mechanism includes a fire extinguisher body filled under pressure with a fire suppressant. The actuation mechanism includes a pneumatically controlled activation piston assembly that functions to control the release of the fire suppressant until desired by the user of the fire extinguisher. The activation piston assembly includes a housing in which a piston is positioned. The housing includes a first end and second end. The first end of the housing is covered with a first cap supporting a spring interposed between the piston and the first cap, and the second end of the housing is provided with a second cap. The piston, under the control of balanced spring bias and pneumatic pressure, allows for time controlled release of the fire suppressant from the fire extinguisher body.

15 Claims, 7 Drawing Sheets

ACTUATION MECHANISM FOR A FIRE EXTINGUISHER

CROSS REFERENCE TO RELATED APPLICATIONS

This application claims the benefit of U.S. Provisional Patent Application Ser. No. 61/386,829, entitled "ACTUATION MECHANISM FOR A FIRE EXTINGUISHER", filed Sep. 27, 2010.

BACKGROUND OF THE INVENTION

1. Field of the Invention

The invention relates to fire extinguishers. More particularly, the invention relates to an actuation mechanism for a fire extinguisher.

2. Description of the Related Art

Typical fire extinguishers include a simple pin and trigger mechanism for actuation thereof. The pin is pulled allowing for movement of the trigger, which opens a valve and allows for the flow of the fire suppressant from the fire extinguisher body.

However, it is at times desirable to control the actuation mechanism for timed release of the fire suppressant from the fire extinguisher. Such actuation mechanisms are, however, either highly limited in their functionality to control the release of fire suppressant from the fire extinguisher or they are highly complicated, and ultimately very expensive. In addition, such mechanisms are currently designed for specific fire extinguisher constructions and, therefore, are not available for use in conjunction with a wide range of fire extinguishers.

A need, therefore, exists for an actuation mechanism capable of controlling the release of fire suppressant from a fire extinguisher which is versatile, inexpensive and universal.

SUMMARY OF THE INVENTION

It is, therefore, an object of the present invention to provide a fire extinguisher with an actuation mechanism. The assembly includes a fire extinguisher body filled under pressure with a fire suppressant in a manner forcibly causing the fire suppressant to be expelled from the fire extinguisher with substantial force upon release and an actuation mechanism secured to the fire extinguisher body for controlling expulsion of the fire suppressant from the fire extinguisher body. The actuation mechanism includes a pneumatically controlled activation piston assembly that functions to control the release of the fire suppressant until desired by the user of the fire extinguisher. The activation piston assembly includes a housing in which a piston is positioned. The housing includes a first end and second end. The first end of the housing is covered with a first cap supporting a spring interposed between the piston and the first cap, and the second end of the housing is provided with a second cap. The piston, under the control of balanced spring bias and pneumatic pressure, allows for time controlled release of the fire suppressant from the fire extinguisher body.

It is also an object of the present invention to provide a fire extinguisher wherein the piston includes a first end and a second end. The first end of the piston is shaped and dimensioned for engaging an end of the spring opposite the first cap at the first end of the housing, which spring biases the piston toward the second end of the housing.

It is another object of the present invention to provide a fire extinguisher wherein the second end of the piston includes a cup seal shaped and dimensioned for engaging an inner wall of the housing in a manner defining a substantially sealed lateral compartment in the housing between the second end of the piston and the second cap.

It is a further object of the present invention to provide a fire extinguisher wherein the cup seal includes a vent hole allowing incompressible air from the sealed lateral compartment to be forced out of the sealed lateral compartment, and toward the first end of the housing, as the spring attempts to move the piston toward the second end of the housing.

It is also an object of the present invention to provide a fire extinguisher including a valve plug seated within a valve seat of an attachment sleeve of the actuation mechanism preventing the flow of pressurized fire suppressant until such a time as the valve plug is released, and movement of the valve plug from the valve seat of the attachment sleeve is prevented until such a time as a valve plug hole formed in the piston is aligned with the valve plug allowing the valve plug to move from the valve seat.

It is another object of the present invention to provide a fire extinguisher wherein the valve plug hole is integrated with the piston and comes into alignment with the valve plug at a specific time and location after the piston is released from its starting position, wherein the starting position of the piston is with the first end of the piston located adjacent to the first end of the housing, and with a body of the piston covering the valve plug and preventing movement thereof.

It is a further object of the present invention to provide a fire extinguisher wherein a piston release pin extends from a pivotally mounted latch and holds the piston in the starting position.

It is also an object of the present invention to provide a fire extinguisher wherein the latch is spring biased to cause removal of the piston release pin from the release pin stay of the piston upon actuation of the latch.

It is another object of the present invention to provide a fire extinguisher including a fusible link selectively securing the second end of the latch to the housing of the activation piston assembly.

It is a further object of the present invention to provide a fire extinguisher including a pull pin, which in conjunction with the fusible link, selectively secures the second end of the latch to the housing of the activation piston assembly.

It is also an object of the present invention to provide a fire extinguisher wherein the first end of the pull pin is secured within a recess formed in the housing and the second end of the pull pin is secured to the second end of the latch by the fusible link thus permitting release of the second end of the latch by either disengagement of the pull pin from the housing or by degradation of the fusible link by encountering excessive heat.

It is another object of the present invention to provide a fire extinguisher wherein the controlled activation piston assembly is secured to the fire extinguisher via an attachment sleeve that connects the present actuation mechanism to the fire extinguisher body in a manner permitting fluid communication from the fire extinguisher body.

It is a further object of the present invention to provide a fire extinguisher wherein the second cap is an end cap.

It is also an object of the present invention to provide a fire extinguisher wherein the second cap is a power shut off mechanism.

It is a further object of the present invention to provide a fire extinguisher wherein the power shut off mechanism includes a normally closed switch secured at the second end of the housing for contact with the second end of the piston upon release of the piston.

It is also an object of the present invention to provide an actuation mechanism for use in conjunction with a fire extinguisher for controlling expulsion of the fire suppressant from the fire extinguisher body. The actuation mechanism includes a pneumatically controlled activation piston assembly that functions to control release of fire suppressant until desired by the user of the fire extinguisher. The activation piston assembly includes a housing in which a piston is positioned. The housing includes a first end and second end. The first end of the housing is covered with a first cap supporting a spring interposed between the piston and the first cap, and the second end of the housing is provided with a second cap. The piston, under the control of balanced spring bias and pneumatic pressure, allows for time controlled release of the fire suppressant from the fire extinguisher body.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
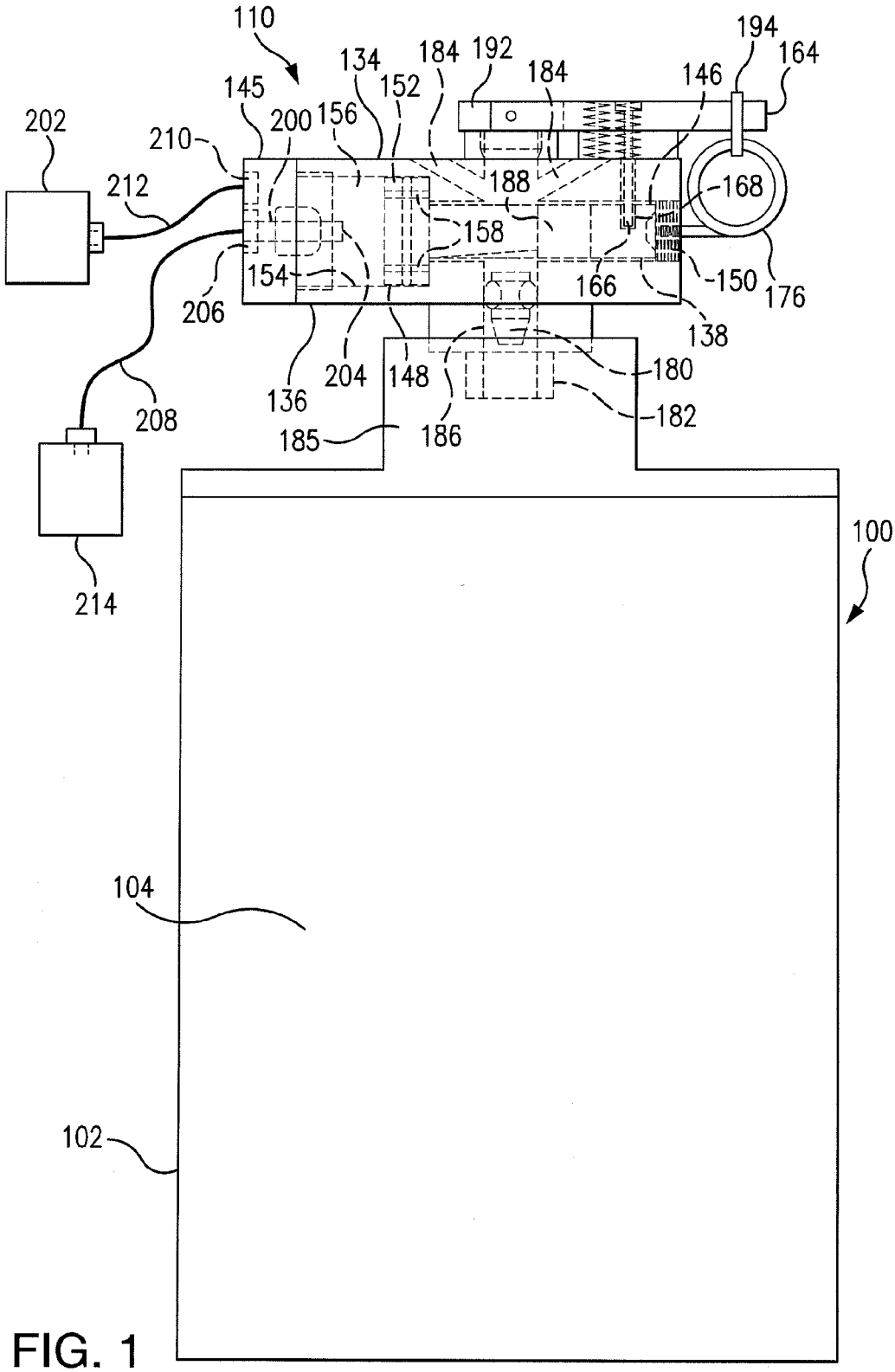
FIG. 1 is a schematic view of the present actuation mechanism secured to a fire extinguisher.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With reference to the various figures, an actuation mechanism 110 for a traditional fire extinguisher 100 is disclosed. The actuation mechanism 110 is designed for permitting controlled delayed release of the fire suppressant expelled from the fire extinguisher 100; for example, time delays of 2-4 seconds or 6-8 seconds. The present actuation mechanism 110 when secured to a fire extinguishing 100 is designed to be thrown at or near a fire. The fire extinguisher 100 with the present actuation mechanism 110 is a non-pyrotechnic operated system. Non-pyrotechnic operation eliminates the risk of "secondary" fire due to a pyrotechnic ignition device. The present actuation mechanism 110 can be used on existing fire extinguisher bodies, or with a special designed container. The actuation mechanism 110 will operate with any existing suppressant agent; for example, dry chemical, water or other suppressant agents.

As will be appreciated based upon the following disclosure, the present actuation mechanism 110 is a pull actuated device designed to be tossed into enclosed spaces with active fires to provide immediate fire suppression. When used by first responders, it provides immediate suppression of the fire until dedicated fire personnel and equipment arrive. In addition, the fire extinguisher 100 with the present actuation mechanism 110 provides suppression of a fire and allows for more time for personnel to egress from confined spaces or other hazardous environments. It is also capable of "knockdown" and fire suppression for enclosed spaces and offers a reliable and cost effective method of fire protection in a wide range of applications.

The present actuation mechanism also may be employed in embodiments using a thermal reactive device that automatically releases the actuation mechanism, and ultimately the fire suppressant at specified temperatures or on contact with flames. The actuation mechanism may further be used in conjunction with a power interruption device, which when activated closes a circuit, eliminating a source of fuel for the fire. All of these various features are described below in the various embodiments disclosed herein.

Briefly, and as discussed below in greater detail, in the event of a fire, the present actuation mechanism 110 is manually activated in three steps: One—remove the safety retaining clip provided with all fire extinguishers (not shown); Two—pull the ring pull pin 176; and Three—throw or place the unit at or near the fire. The device will actuate following a 2-4 or 6-8 second time delay. Upon activation, the fire extinguisher 100 with the present actuation mechanism 110 produces an effective suppressant that provides fast knockdown and rapid suppression of fires.

In particular, a fire extinguisher 100 generally includes a body 102 onto which an actuation mechanism 110 is secured. With the exception of utilization of the present actuation mechanism 110, the fire extinguisher 100 employing the present delayed actuation mechanism 110 operates in much the same manner as a conventional fire extinguisher 100. As such, the fire extinguisher 100 includes a fire extinguisher body 102 filled under pressure with a fire suppressant 104 in a manner forcibly causing the fire suppressant 104 to be expelled from the fire extinguisher 100 with substantial force upon release.

Controlled release of the fire suppressant 104 from the fire extinguisher body 102 is achieved through the utilization of the present actuation mechanism 110. As will be discussed below in greater detail, the actuation mechanism 110 includes a pneumatically controlled activation piston assembly 134 that functions to control the release of a valve plug 180 and ultimately the release of fire suppressant 104 until desired by the user of the fire extinguisher 100. The controlled activation piston assembly 134 is secured to the fire extinguisher 100 via an attachment sleeve 182 that connects the present actuation mechanism 110 to the fire extinguisher body 102 in a manner permitting fluid communication from the fire extinguisher body 102, through the actuation mechanism 110 and out dispensing holes 184 in a manner discussed below in greater detail. The attachment sleeve 182 is threaded for attached to the threaded opening 185 in the fire extinguisher body 102.

While the present actuation mechanism is disclosed for use in conjunction with a fire extinguisher, it is contemplated it could be used in other similar applications. For example, it is contemplated it could be used as a replacement for a sprinkler head in an existing fire prevention system.

Figure 5:
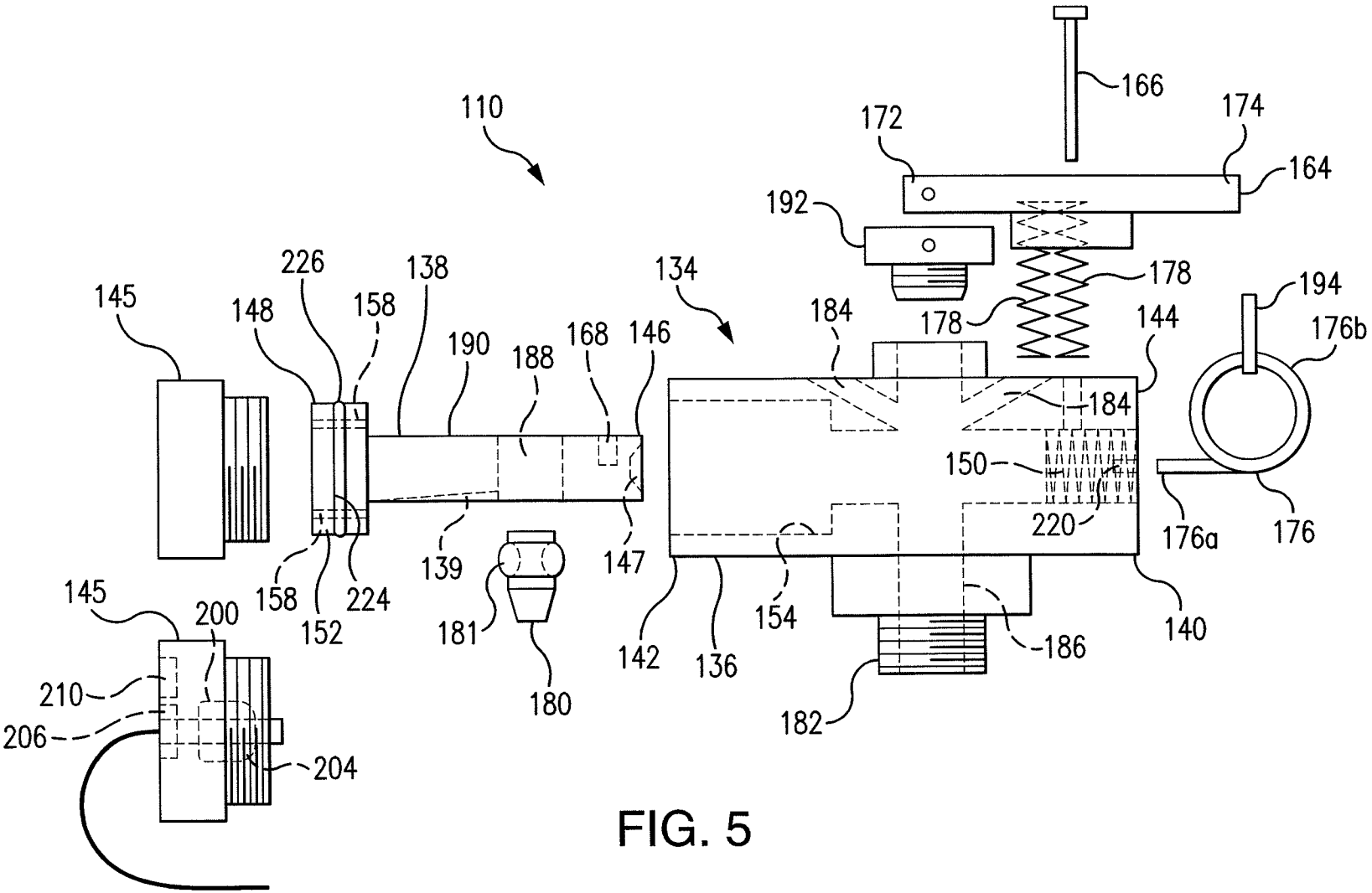
FIG. 5 is an exploded side view of the present actuation mechanism.
Figure 6:
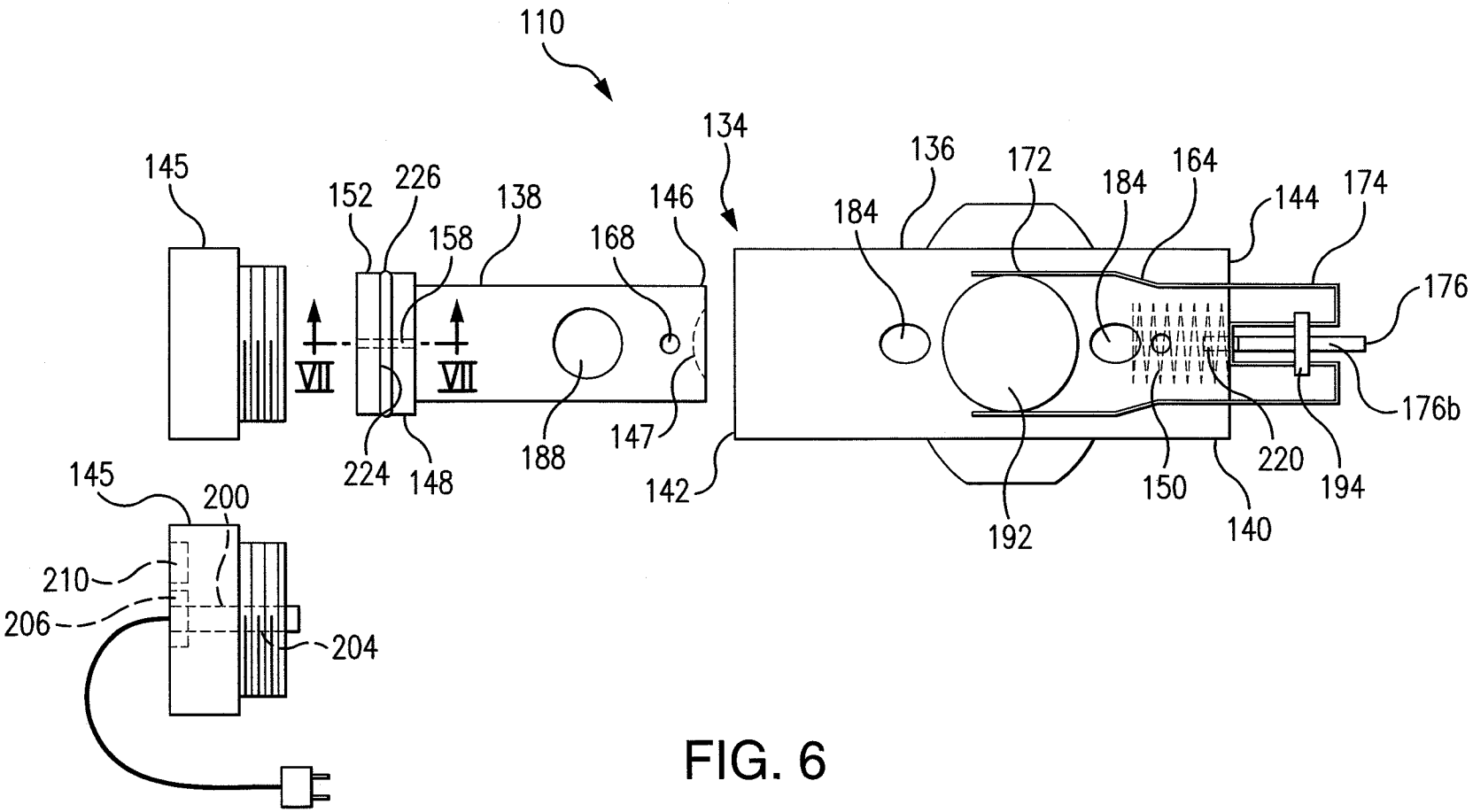
FIG. 6 is an exploded top view of the present actuation mechanism.

The activation piston assembly 134 includes a housing 136 shaped and dimensioned for receiving a piston 138. The housing 136 is cylindrical and includes a first end 140 and second end 142. The first end 140 of the housing 136 is covered with a first cap, or end wall, 144 supporting a spring 150 interposed between the piston 138 and the first cap 144. The second end 142 of the housing 136 is provided with a second cap 145. The second cap 145 may simply be an end cap or may be formed with a power shut off mechanism 200 as discussed below in greater detail (both are shown in FIGS. 5 and 6, while the embodiments in FIGS. 1-4 show the assembled actuation mechanism with the power shut off mechanism 200).

The piston 138, under the control of balanced spring bias and pneumatic pressure, allows for time controlled release of the fire suppressant 104 from the fire extinguisher body 102. More particularly, the piston 138 includes a first end 146 and a second end 148. The first end 146 of the piston 138 is shaped and dimensioned for engaging the end of the spring 150 opposite the first cap 144 at the first end 140 of the housing 136 and includes a receiving recess 147. As a result, the piston 138 is biased toward the second end 142 of the housing 136.

Figure 7:
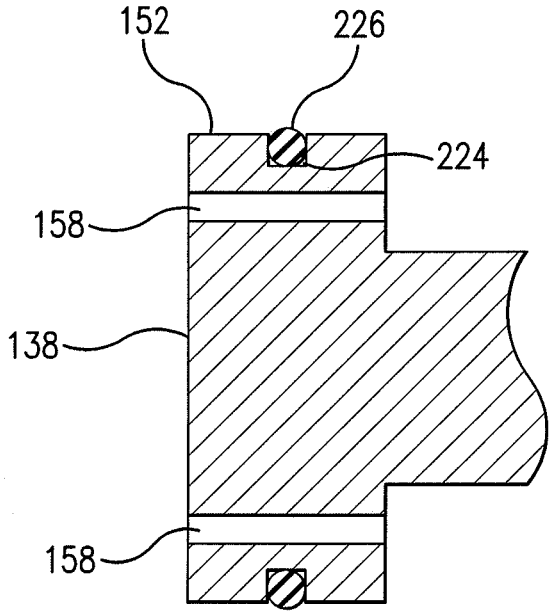
FIG. 7 is a cross sectional view of the cup seal along the line VII-VII in FIG. 6 showing the vent hole.

The second end 148 of the piston 138 includes a cup seal, or piston head, 152 shaped and dimensioned for engaging the inner wall 154 of the housing 136 in manner defining a substantially sealed lateral compartment 156 in the housing 136. The cup seal 152 is provided with a circumferential recess 224 in which an O-ring 226 is positioned. With this in mind, and considering the spring 150 biasing the piston 138 toward the second end 142 of the housing 136 against the sealed lateral compartment 156, it is necessary to vent the sealed lateral compartment 156 to allow for movement of the piston 138 toward the second end 142 of the housing 136. Accordingly, and with particular reference to FIG. 7, the cup seal 152 is provided with a small vent hole(s) 158, allowing incompressible air from the sealed lateral compartment 156 to be forced out of the sealed lateral compartment 156, and toward the first end 140 of the housing 136, as the spring 150 attempts to move the piston 138 toward the second end 142 of the housing 136. Because the speed at which the piston 138 will move is a function of the spring pressure being applied by the spring 150 and the size of the vent hole 158, the present activation piston assembly 134 allows for controlled movement of the piston 138 from its start position toward the second end 142 of the housing 136. It is also appreciated, although two vent holes are disclosed in accordance with a preferred embodiment of the present invention, the cup seal 152 may be provided with one or more vent holes depending upon the specifics of the application.

Figure 8:
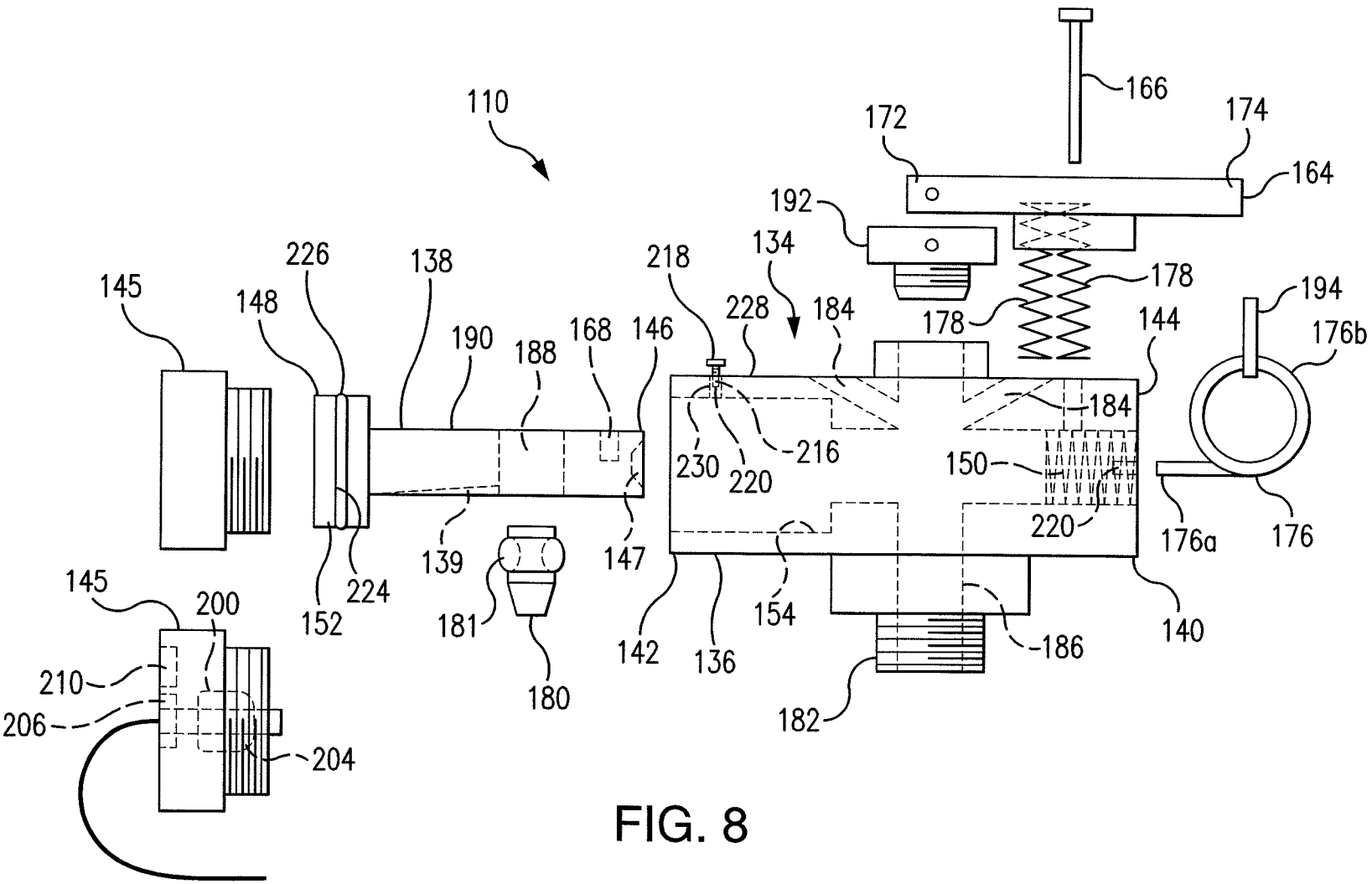
FIG. 8 is an exploded side view of an alternate actuation mechanism incorporating a metering pin for controlling the flow of air from the sealed lateral compartment.

Referring to FIG. 8 (similar references numerals are used for those parts previously described herein in conjunction with the other embodiment), the vent hole 158 described above with reference to FIGS. 1 to 7, is replaced with a metering pin 216 in the housing 136 adjacent the second cap 145 at the second end 142 of the housing 136. The metering pin 216 allows for the controlled release of non-compressible air as the piston 138 is moved toward the second end 142 of the housing 136. In particular, metering pin 216 is of conventional design and is positioned within an aperture 230 in the wall 228 of the housing 136 for controlled movement therein, for example, via threaded rotational interaction between the metering pin 216 and the aperture 230 via a screw driver engaging the proximal end 218 of the metering pin 216. Movement of the metering pin 216 functions to adjust the effective passageway for air defined by the aperture 230 and the metering pin 216 by moving the distal end 220 of the metering pin 216 within the aperture 230. As is appreciated, due to the respective shapes of the aperture 230 and the metering pin 216, which may be varied as is well known in the art, the effective passageway for air is altered for controlling the velocity at which air may flow therethrough based upon the pressure being applied to the piston 138. Through the use of this embodiment, the sealed lateral compartment 156 is fully sealed from the flow of fire suppressant and thereby protects the power shut off mechanism 200 from interaction with the fire suppressant upon actuation of the fire extinguisher 100.

In accordance with an alternate embodiment, it is contemplated there may be times where the controlled movement of the piston 138 facilitated by the interaction of the spring 150, cup seal 152, and the vent hole 158 is not necessary since a user will desire release of the fire suppressant 104 immediately upon actuation of the actuation mechanism 110. As such, the cup seal 152 and vent hole 158 may be removed allowing for substantially free movement of the piston 138 under the control of the spring 150 as discussed below in greater detail.

As discussed above, a valve plug 180 is seated within the attachment sleeve 182 of the actuation mechanism 110 preventing the flow of pressurized fire suppressant 104 until such a time as the valve plug 180 is released. Secure placement is facilitated by the provision of an O-ring 181 about the valve plug 180. The valve plug 180 is mounted for lateral movement, that is, the valve plug 180 is mounted for movement diametrically relative to the cylindrical shape of the housing 136, in the housing 136. Movement of the valve plug 180 results from the pressure of the fire suppressant 104 pushing the valve plug 180 from the lower side of the housing 136 where it is mounted in a valve seat 186 of the attachment sleeve 182. Once the valve plug 180 is pushed from the valve seat 186, it is moved to the upper side of the housing 136. The valve plug 180 moves from the valve seat 186 of the attachment sleeve 182 and allows the flow of pressurized fire suppressant 104 from the fire extinguisher body 102, through the attachment sleeve 182 and through the dispensing holes 184 formed along the upper wall of the housing 136. However, movement of the valve plug 180 from the valve seat 186 of the attachment sleeve 182 is prevented by positioning of the piston 138 until such a time as the valve plug hole 188 formed in the piston 138 is aligned with the valve plug 180 allowing it to move from the valve seat 186.

Figure 2:
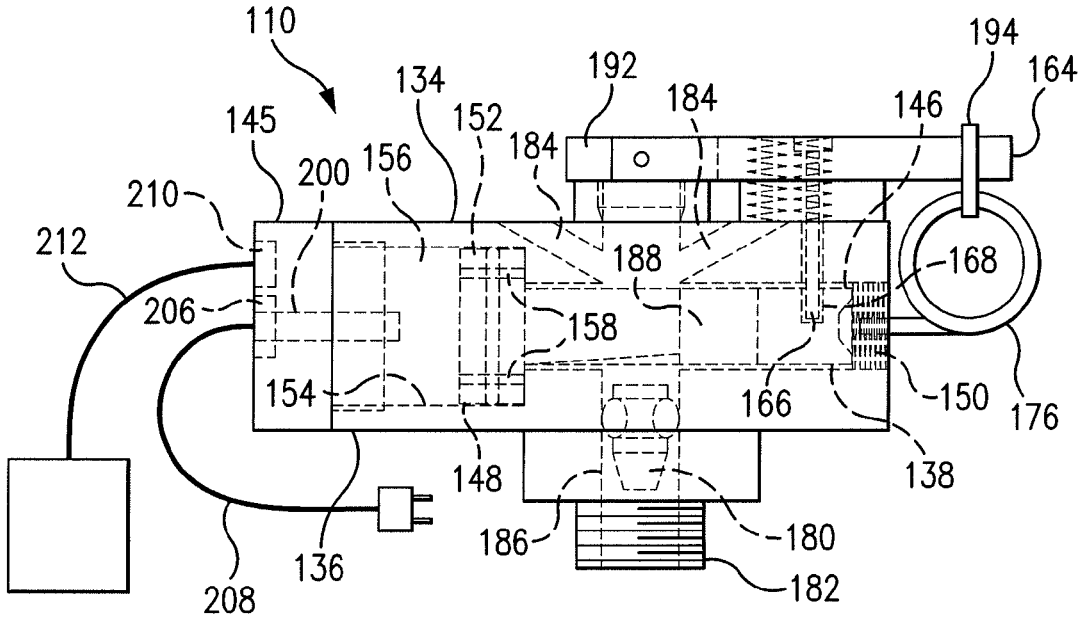
FIGS. 2, 3 and 4 are schematic views showing operation of the present actuation mechanism.
Figure 3:
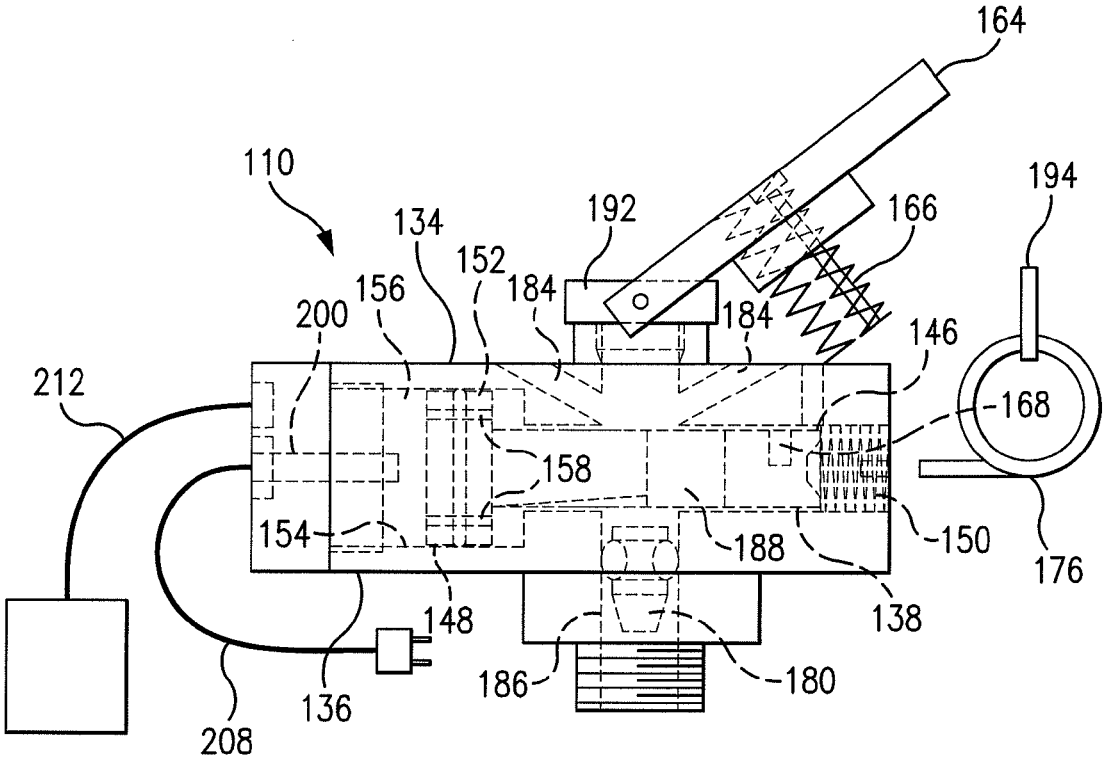

The valve plug hole 188 is integrated with the piston 138 and comes into alignment with the valve plug 180 at a specific time and location after the piston 138 is released from its starting position. With reference to FIGS. 1 and 2, the start position of the piston 138 is with the first end 146 of the piston 138 located adjacent to the first end 140 of the housing 136, and with the body 190 of the piston 138 covering the valve plug 180 and preventing movement thereof. The piston 138 is held in position, when in its start position, by a piston release pin 166 extending from a pivotally mounted latch 164. The latch 164 is resiliently biased by spring 178 to cause removal of the piston release pin 166 from the release pin stay 168 of the piston 138 upon actuation of the latch 164.

More particularly, the latch 164 includes a first end 172 pivotally secured to the lever pivot 192 secured to the housing 136 and a second end 174 selectively secured to the housing 136 of the activation piston assembly 134 by a fusible link 194 and a pull pin 176. As will be appreciated based upon the following disclosure, the first end **176*a* of the pull pin 176 is secured within a recess 220 formed in the housing 136 and the second end 176*b* of the pull pin 176 is secured to the second end 174 of the latch 164 by the fusible link 194 thus permitting release of the second end 174 of the latch 164 by either disengagement of the pull pin 176 from the housing 136 or by degradation of the fusible link 194 by encountering excessive heat. The fusible link 194 is secured to the second end 176*b* of the pull pin and a central slot 222 formed in the second end 174 of the latch 164 for holding the latch 164 in its starting position as shown in FIGS. 1, 2 and 6**.

The piston release pin 166 is positioned centrally along the latch 164 for engagement with the release pin stay 168 of the piston 138. Upon removal of the pull pin 176 from the recess 220 within the housing 136 or disengagement of the pull pin 176 from the second end 174 of the latch 164 by degradation of the fusible link 194 by the application of excessive heat, the latch 164 rotates upwardly under the bias of a spring 178, causing the piston release pin 166 to move from the release pin stay 168 of the piston 138, allowing movement of the piston 138 under the control of the spring 150 (see FIG. 3). The movement of the piston 138 is caused by the spring 150 pushing the piston 138 toward the second end 142 of the housing 136 under the control of the vent hole 158 that releases pressure from the sealed lateral compartment 156 allowing for movement of the piston 138 toward the second end of the housing 136.

In practice, and in accordance with one actuation mechanism, the latch 164 is actuated by removing the pull pin 176 from engagement with the housing 136, that is, from the recess 220 formed within the housing 136. This allows rotation of the latch 164, which moves the piston release pin 166 from the release pin stay 168 (see FIG. 3). The spring 150 then moves the piston 138 toward the second end 142 of the housing 136 (see FIG. 4). Movement of the piston 138 is facilitated by the inclusion of a guide recess 139 along the surface thereof. The guide recess 139 is shaped and dimensioned for engagement with the upper end of the valve plug 180 as the piston 138 moves relative thereto. The guide recess 139 is formed with an inclined (for example, 10 degree) surface for reducing frictional resistance as the piston 138 moves relative to the valve plug 180.

Figure 4:
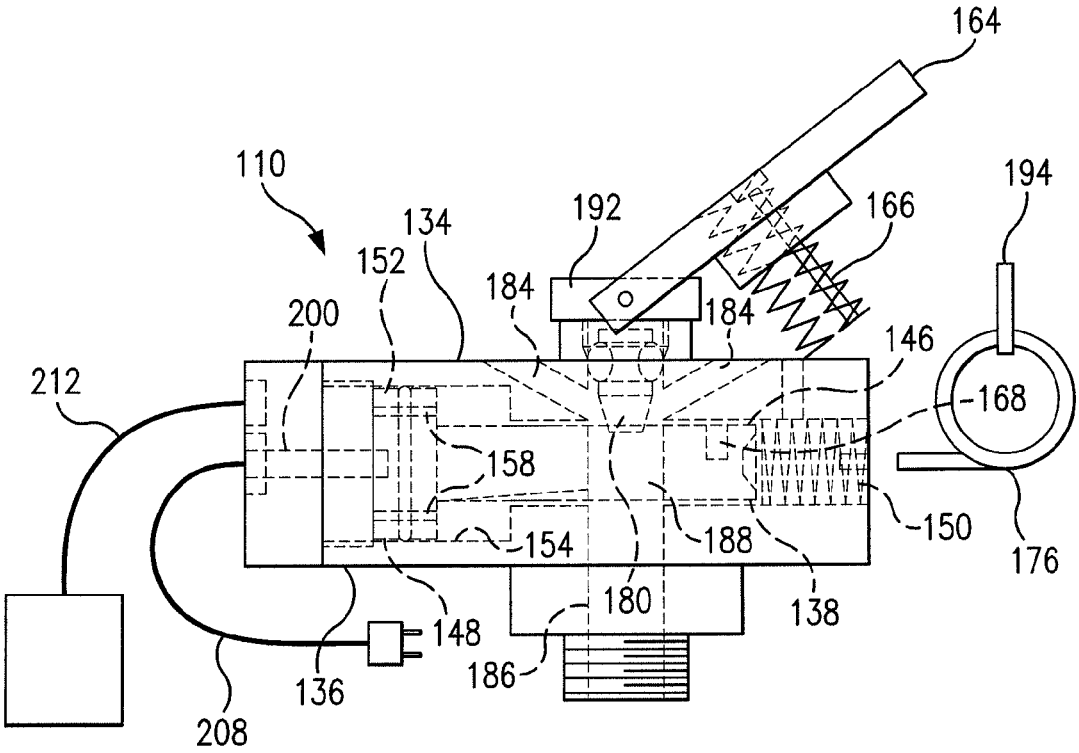

Referring to FIG. 4, when the valve plug 188 hole moves into alignment with the valve plug 180, the valve plug 180 moves upwardly from the valve seat 186 of the attachment sleeve 182 under the control of the pressurized fire suppressant 104 and the fire suppressant 104 is free to exit the fire extinguisher body 102, pass through the passageway defined by the attachment sleeve 182, enter the central cavity defined by the housing 136 and forcefully spray from the dispensing holes 184 formed in the upper wall of the housing 136.

In accordance with a second actuation mechanism 110, the latch 164 is actuated by a breakdown of a heat sensitive fusible link 194 connecting the pull pin 176 to the second end 174 of the latch 164. Upon the application of heat, the fusible link 194 connecting the pull pin 176 to the second end 174 of the latch 164 degrades allowing for movement of the latch 164 under the control of the spring 196. When this occurs, the latch 164 rotates upwardly, which moves the piston release pin 166 from the release pin stay 168, permitting movement of the piston 138 as described above.

Additional functionality is provided by the present actuation mechanism 110 via the incorporation of a power shut off mechanism 200 in second cap 145 of the housing 136 which is actuated to shut off power to a specific appliance or product 202 upon actuation of the actuation mechanism 110 in the manner described above. In accordance with a preferred embodiment, a normally closed switch 204 is secured at the second end 142 of the housing 136 for contact with the second end 148 of the piston 138 upon release of the piston 138. The switch 204 includes a male coupling member 206 for receiving a power supply line 208 and male plug 210 for attachment to the cord 212 of an appliance or other electrically powered device 202. As such, and when the switch 204 is closed, power is permitted to freely flow from the power supply 214, through the switch power shut off mechanism 200 and to the electrical appliance 202. However, when the actuation mechanism 110 is actuated based upon the need for fire suppression, either by manually pulling the pull pin 176 or by the breakdown of the fusible link 194, the piston 138 contacts the switch 204. On contact with the switch 204, the power shut off mechanism 200 stops the flow of electricity therethrough, thereby shutting down the electrical appliance or other product 202. Consequently, and in addition to spraying fire suppressant 104 upon a desired product, the present invention shuts down the product preventing further damage. While a specific switch assembly is disclosed in accordance with a preferred embodiment, it is contemplated other switch assemblies could be employed within the spirit of the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A fire extinguisher with an actuation mechanism, comprising:

a fire extinguisher body filled under pressure with a fire suppressant in a manner forcibly causing the fire suppressant to be expelled from the fire extinguisher with substantial force upon release:

an actuation mechanism secured to the fire extinguisher body for controlling expulsion of the fire suppressant from the fire extinguisher body, the actuation mechanism includes:

a pneumatically controlled activation piston assembly that functions to control the release of the fire suppressant until desired by the user of the fire extinguisher, the activation piston assembly includes a housing in which a piston is positioned, the housing includes a first end and second end, the first end of the housing is covered with a first cap supporting a spring interposed between the piston and the first cap, and the second end of the housing is provided with a second cap; the piston, under the control of balanced spring bias and pneumatic pressure, allows for time controlled release of the fire suppressant from the fire extinguisher body, wherein the piston includes a first end and a second end, the first end of the piston is shaped and dimensioned for engaging an end of the spring opposite the first cap at the first end of the housing, which spring biases the piston toward the second end of the housing, and wherein the second end of the piston includes a cup seal shaped and dimensioned for engaging an inner wall of the housing in manner defining a substantially sealed lateral compartment in the housing between the second end of the piston and the second cap.

2. The fire extinguisher according to claim 1, wherein the cup seal includes a vent hole allowing incompressible air from the sealed lateral compartment to be forced out of the sealed lateral compartment, and toward the first end of the housing, as the spring attempts to move the piston toward the second end of the housing.

3. A fire extinguisher with an actuation mechanism, comprising:

a fire extinguisher body filled under pressure with a fire suppressant in a manner forcibly causing the fire suppressant to be expelled from the fire extinguisher with substantial force upon release;

an actuation mechanism secured to the fire extinguisher body for controlling expulsion of the fire suppressant from the fire extinguisher body, the actuation mechanism includes:

a pneumatically controlled activation piston assembly that functions to control the release of the fire suppressant until desired by the user of the fire extinguisher, the activation piston assembly includes a housing in which a piston is positioned, the housing includes a first end and second end, the first end of the housing is covered with a first cap supporting a spring interposed between the piston and the first cap, and the second end of the housing is provided with a second cap; the piston, under the control of balanced spring bias and pneumatic pressure, allows for time controlled release of the fire suppressant from the fire extinguisher body, and further including a valve plug seated within a valve seat of an attachment sleeve of the actuation mechanism preventing the flow of pressurized fire suppressant until such a time as the valve plug is released, and movement of the valve plug from the valve seat of the attachment sleeve is prevented until such a time as a valve plug hole formed in the piston is aligned with the valve plug allowing the valve plug to move from the valve seat.

4. The fire extinguisher according to claim 3, wherein the valve plug hole is integrated with the piston and comes into alignment with the valve plug at a specific time and location after the piston is released from its starting position, wherein the starting position of the piston is with the first end of the piston located adjacent to the first end of the housing, and with a body of the piston covering the valve plug and preventing movement thereof.

5. The fire extinguisher according to claim 4, wherein a piston release pin extends from a pivotally mounted latch and holds the piston in the starting position.

6. The fire extinguisher according to claim 5, wherein the latch is spring biased to cause removal of the piston release pin from the release pin stay of the piston upon actuation of the latch.

7. The fire extinguisher according to claim 6, further including a fusible link selectively securing the second end of the latch to the housing of the activation piston assembly.

8. The fire extinguisher according to claim 7, further including a pull pin, which in conjunction with the fusible link, selectively secures the second end of the latch to the housing of the activation piston assembly.

9. The fire extinguisher according to claim 8, wherein the first end of the pull pin is secured within a recess formed in the housing and the second end of the pull pin is secured to the second end of the latch by the fusible link thus permitting release of the second end of the latch by either disengagement of the pull pin from the housing or by degradation of the fusible link by encountering excessive heat.

10. The fire extinguisher according to claim 1, wherein the controlled activation piston assembly is secured to the fire extinguisher via an attachment sleeve that connects the present actuation mechanism to the fire extinguisher body in a manner permitting fluid communication from the fire extinguisher body.

11. A fire extinguisher with an actuation mechanism, comprising:

a fire extinguisher body filled under pressure with a fire suppressant in a manner forcibly causing the fire suppressant to be expelled from the fire extinguisher with substantial force upon release;

an actuation mechanism secured to the fire extinguisher body for controlling expulsion of the fire suppressant from the fire extinguisher body, the actuation mechanism includes:

a pneumatically controlled activation piston assembly that functions to control the release of the fire suppressant until desired by the user of the fire extinguisher, the activation piston assembly includes a housing in which a piston is positioned, the housing includes a first end and second end, the first end of the housing is covered with a first cap supporting a spring interposed between the piston and the first cap, and the second end of the housing is provided with a second cap; the piston, under the control of balanced spring bias and pneumatic pressure, allows for time controlled release of the fire suppressant from the fire extinguisher body, the second cap being an end cap and a power shut off mechanism, wherein the power shut off mechanism includes a normally closed switch secured at the second end of the housing for contact with the second end of the piston upon release of the piston.

12. An actuation mechanism for use in conjunction with a fire extinguisher for controlling expulsion of the fire suppressant from the fire extinguisher body, comprising:

a pneumatically controlled activation piston assembly that functions to control release of the fire suppressant until desired by the user of the fire extinguisher, the activation piston assembly includes a housing in which a piston is positioned, the housing includes a first end and second end, the first end of the housing is covered with a first cap supporting a spring interposed between the piston and the first cap, and the second end of the housing is provided with a second cap; the piston, under the control of balanced spring bias and pneumatic pressure, allows for time controlled release of the fire suppressant from the fire extinguisher body, wherein the piston includes a first end and a second end, the first end of the piston is shaped and dimensioned for engaging an end of the spring opposite the first cap at the first end of the housing, which spring biases the piston toward the second end of the housing; and the second end of the piston includes a cup seal shaped and dimensioned for engaging an inner wall of the housing in manner defining a substantially sealed lateral compartment in the housing between the second end of the piston and the second cap; and wherein the cup seal includes a vent hole allowing incompressible air from the sealed lateral compartment to be forced out of the sealed lateral compartment, and toward the first end of the housing, as the spring attempts to move the piston toward the second end of the housing.

13. An actuation mechanism for use in conjunction with a fire extinguisher for controlling expulsion of the fire suppressant from the fire extinguisher body, comprising:

a pneumatically controlled activation piston assembly that functions to control release of the fire suppressant until desired by the user of the fire extinguisher, the activation piston assembly includes a housing in which a piston is positioned, the housing includes a first end and second end, the first end of the housing is covered with a first cap supporting a spring interposed between the piston and the first cap, and the second end of the housing is provided with a second cap; the piston, under the control of balanced spring bias and pneumatic pressure, allows for time controlled release of the fire suppressant from the fire extinguisher body, further including a valve plug seated within a valve seat of an attachment sleeve of the actuation mechanism preventing the flow of pressurized fire suppressant until such a time as the valve plug is released, and movement of the valve plug from the valve seat of the attachment sleeve is prevented until such a time as a valve plug hole formed in the piston is aligned with the valve plug allowing the valve plug to move from the valve seat.

14. An actuation mechanism for use in conjunction with a fire extinguisher for controlling expulsion of the fire suppressant from the fire extinguisher body, comprising:

a pneumatically controlled activation piston assembly that functions to control release of the fire suppressant until desired by the user of the fire extinguisher, the activation piston assembly includes a housing in which a piston is positioned, the housing includes a first end and second end, the first end of the housing is covered with a first cap supporting a spring interposed between the piston and the first cap, and the second end of the housing is provided with a second cap; the piston, under the control of balanced spring bias and pneumatic pressure, allows for time controlled release of the fire suppressant from the fire extinguisher body, the second end cap being a power shut off mechanism wherein the power shut off mechanism includes a normally closed switch secured at the second end of the housing for contact with the second end of the piston upon release of the piston.

15. The fire extinguisher according to claim 3, wherein the controlled activation piston assembly is secured to the fire extinguisher via an attachment sleeve that connects the present actuation mechanism to the fire extinguisher body in a manner permitting fluid communication from the fire extinguisher body.

* * * * *